US007755503B2

(12) United States Patent
Bonorden et al.

(10) Patent No.: US 7,755,503 B2
(45) Date of Patent: Jul. 13, 2010

(54) SYSTEM AND METHOD FOR ERROR MESSAGING OF AN INCORRECT INFORMATION HANDLING SYSTEM GRAPHICS CABLE CONNECTION

(75) Inventors: David Bonorden, Cedar Park, TX (US); Stanley Osgood, Georgetown, TX (US)

(73) Assignee: Dell Products L.P., Round Rock, TX (US)

( * ) Notice: Subject to any disclaimer, the term of this patent is extended or adjusted under 35 U.S.C. 154(b) by 1792 days.

(21) Appl. No.: 10/869,750

(22) Filed: Jun. 16, 2004

(65) Prior Publication Data

US 2005/0280640 A1 Dec. 22, 2005

(51) Int. Cl.
*G08B 21/00* (2006.01)

(52) U.S. Cl. ..... 340/686.1

(58) Field of Classification Search ..... 340/686.1
See application file for complete search history.

(56) References Cited

U.S. PATENT DOCUMENTS

| | | | | |
|---|---|---|---|---|
| 4,499,569 | A | 2/1985 | Lopez De Romana | 369/45 |
| 5,421,416 | A | 6/1995 | Orbach et al. | 172/4 |
| 5,588,114 | A | 12/1996 | Bhatia | 395/183.01 |
| 6,039,410 | A | 3/2000 | Robertson et al. | 303/7 |
| 6,184,861 | B1 * | 2/2001 | Callway | 345/690 |
| 6,221,095 | B1 | 4/2001 | Van Zuylen et al. | 607/88 |
| 6,513,154 | B1 | 1/2003 | Porterfield | 717/101 |
| 6,575,905 | B2 | 6/2003 | Knobbe et al. | 600/365 |
| 7,043,691 | B1 * | 5/2006 | Kwon et al. | 715/705 |
| 7,334,054 | B2 * | 2/2008 | Anderson | 710/15 |
| 2004/0078708 | A1 * | 4/2004 | Li et al. | 714/43 |

OTHER PUBLICATIONS www2.faa.gov/and/and300/and320/vscs/vtabs_spec1.pdf Voice Switching and Control System Training and Backup Switch (VTABS) Specification FAA-E-2914, Jan. 15, 1997.

www.polaroid.com/service/userguides/digital/pv_330_ug.pdf "Polaroid Polaview LCD Projector 330 User's Guide" Aug. 16, 2004.

* cited by examiner

*Primary Examiner*—Daniel Wu
*Assistant Examiner*—Naomi Small
(74) *Attorney, Agent, or Firm*—Hamilton & Terrile, LLP; Robert W. Holland

(57) ABSTRACT

An incorrect connection of an information handling system graphics cable to a display peripheral is automatically detected with an error message presented by the display peripheral. For instance, a graphics projector accepts a VGA input from an information handling system through a VGA cable and port to project information for display. The graphics projector includes a graphics output loop that sends inputted VGA signals to an output port for communication to other peripherals, such as monitor. A cable connector detector associated with the VGA output port detects the incorrect coupling of a cable carrying an incoming graphics signal and displays an error message from the projector that the cable is connected to an incorrect port, such as a depiction of the input and output ports or a video showing disconnection of the cable from the outbound port and reconnection of the cable to the inbound port.

20 Claims, 2 Drawing Sheets

SYSTEM AND METHOD FOR ERROR MESSAGING OF AN INCORRECT INFORMATION HANDLING SYSTEM GRAPHICS CABLE CONNECTION

BACKGROUND OF THE INVENTION

1. Field of the Invention

The present invention relates in general to the field of information handling system cable connections, and more particularly to a system and method for error messaging of an incorrect information handling system graphics cable connection to a projector.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems often interact with a number of peripherals to communicate, print, display or otherwise process information. For instance, graphics projectors are typically used to project images of multimedia information generated by information handling systems, such as documents, photographs and videos, for display to large groups of people, such as in a conference room. Often, users that present information prefer to view the information on a separate display peripheral. To support simultaneous display of information by the graphics projector and a separate monitor, graphics projectors typically include a monitor loop that takes a signal received at an input port and outputs the signal to an output port for communication to the separate peripheral. The monitor loop generally buffers an re-transmits the incoming graphics input signal on the output connector to drive the additional display peripheral. Monitor loops are often built as collocated VGA compliant connections as a convenient option for displaying information through both the projector and a separate monitor where an information handling system has only a single VGA graphics card and output port.

One difficulty that sometimes arises with collocation of input and output VGA connectors on a graphics projector is that a user will inadvertently connect a VGA graphics cable that carries an inbound signal to the output port instead of the input port. Outbound and inbound ports having VGA compliant connections have the same form factor, and both ends of a VGA cable have pins aligned with the same form factor so that either end may be used as either the input or output connection. If a user incorrectly connects a VGA graphics cable so that the cable carries a graphics signal from an information handling system to the output port of a graphics projector, the graphics projector will only display its normal "no signal" display. Users are often confused by the inability to obtain an image from the graphics projector since, in the user's mind, the cable connector fit into a port. Often users will call the information handling system manufacturer to seek help in obtaining an image from the graphics projector. However, analysis of a projection failure over the phone is difficult since users often insist that the cable is properly connected. Thus, such graphics projector failures often result in needless returns to the manufacturer.

SUMMARY OF THE INVENTION

Therefore a need has arisen for a system and method which provides an error message at a display peripheral for incorrect graphics cable connections to the display peripheral.

In accordance with the present invention, a system and method are provided which substantially reduce the disadvantages and problems associated with previous methods and systems for connecting an information handling system to a display peripheral. Connection of an input signal from the information handling system to an output port of the display peripheral is detected at the display peripheral to result in presentation at the display peripheral of an appropriate error message to inform a user of the incorrect cable connection.

More specifically, a graphics projector includes a VGA input port with a monitor loop to a VGA output port. A cable connection detector interfaced with the output port detects an incoming signal to the output port by detecting a VGA reference signal communicated through the cable with the graphics signal. Detection of the incoming signal to the output port automatically results in display of an error message from the graphics projector to inform the user of the connection error. For instance, an image of the projector is displayed with the input and output ports illustrated to visually show the user the proper configuration. As another example, a video depicts correction of the detected problem by showing disconnection of the cable from the output port and reconnection to the input port.

The present invention provides a number of important technical advantages. One example of an important technical advantage is that an error message is automatically presented at a display peripheral to notify the user of an incorrectly connected graphics cable. An appropriate error message designed to obtain a user's attention and to offer the solution of disconnecting and reconnecting the graphics cable generally results in quick user recognition and correction of graphics projector failure due to an incorrect cable connection. If the user nevertheless calls a technician to obtain help, the presentation of the error message will provide the technician with a clear indication of the problem for explaining corrective measures to the user, thus reducing needless returns of graphics projectors.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

An incorrect cable connection to an information handling system display peripheral is automatically detected at the display peripheral to allow presentation of an error message by the display peripheral even though communication with the information handling system is not established. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
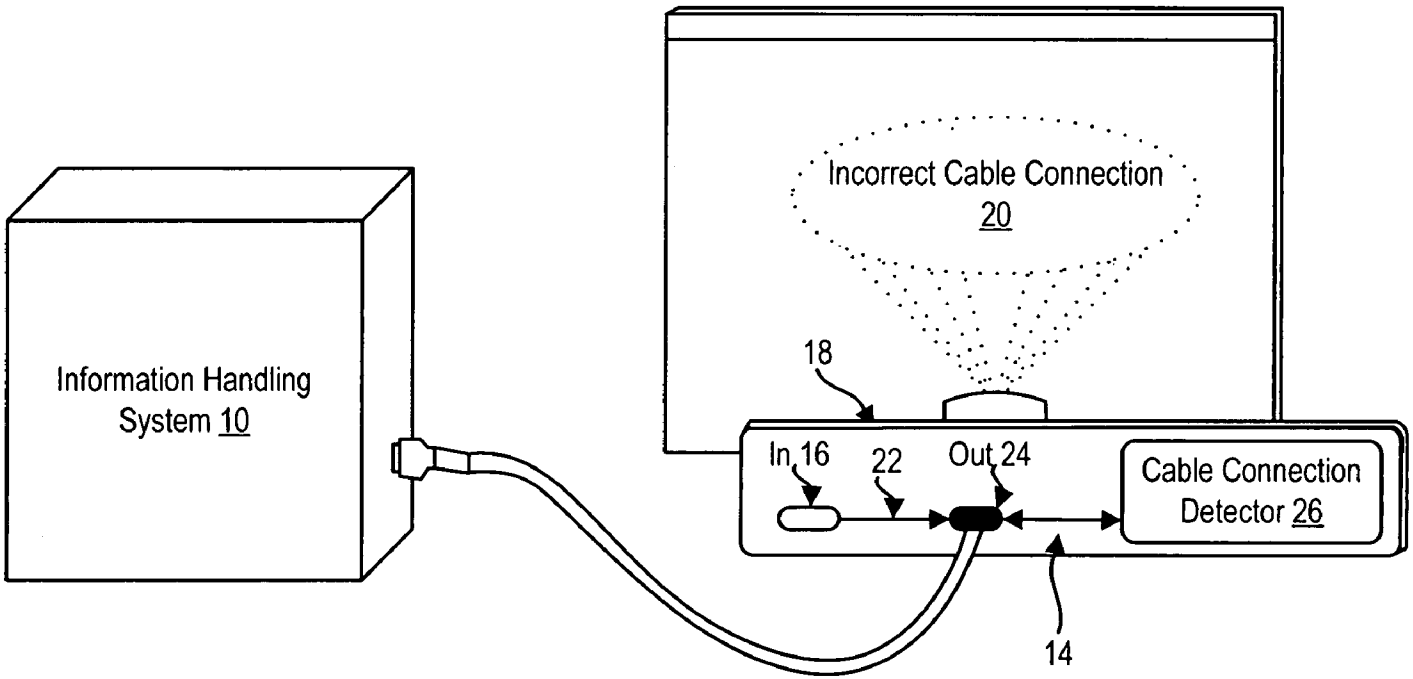
FIG. 1 depicts a block diagram of a system for providing error messages with an incorrect cable connection.

Referring now to FIG. 1, a block diagram depicts a system for display of an error message by a display peripheral when a graphics cable from the information handling system to the display peripheral is incorrectly connected. Information handling system 10 includes processing components and multimedia applications that prepare information as graphics signals for communication to display peripherals that display the information. For instance, information handling system 10 includes a processor running an application that generates multimedia information, which is output through a VGA graphics card as a VGA compliant graphics signal. The graphics signal is communicated from information handling system 10 through a VGA cable 12 to a graphics projector 14 for projection of an image that displays the generated multimedia information. The VGA cable has connecting leads on each end which have the same form factor so that either connecting lead will couple with the information handling system output port or the projector input port.

Graphics projector 14 accepts VGA graphic signal inputs through an input port 16 and process the signals with processing components disposed within its housing 18 to project an image of the inputted multimedia information with a powerful lamp that illuminates against a screen 20. Graphics projector 14 includes a monitor loop 22 that communicates information received at input port 16 to an output port 24. Monitor loop 22 and output port 24 support connection of an additional display peripheral that displays the same information as graphics projector 14. For instance, a user giving a presentation often uses a local display monitor supported by output port 24 during the presentation as a reference instead of the image presented by graphics projector 14.

Figure 2:
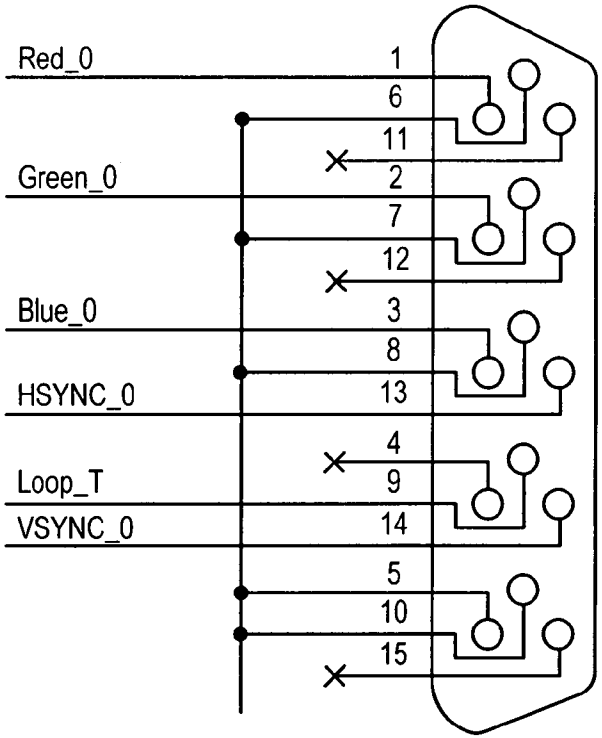
FIG. 2 depicts pin connections of a VGA cable.

The difficulty created by collocation of input and output VGA ports is that each port has the same form factor, as depicted in FIG. 2. Each port accepts pins extending from a VGA compliant cable with green, red, blue, horizontal synchronization, vertical synchronization, ground and a reference signal of 5 Volts having current of up to 50 mAmps, labeled in FIG. 2 as LOOP_T. The reference signal is described in the VGA specification and generally is used to detect insertion of a cable into a port. Since both the input and output ports have the same form factor, a user may inadvertently insert the cable lead extending from an information handling system and carrying a graphics signal into the output port 24 of graphics projector 14 instead of the input port 16, as depicted in FIG. 1. Application of an inbound graphics signal to an output port will not result in any effective signal communication to graphics projector 14, and will leave graphics projector 14 without an output image. Although FIG. 1 depicts this difficulty as arising from the same form factors used for input and output VGA ports, similar difficulties could arise with other connectors that have the same or different form factors.

In order to provide an error message that instructs a user to reconnect the graphics cable to the input port, a cable connection detector 26 interfaces with output port 24 to monitor for an inbound graphics signal. For instance, with a VGA compliant output port 24 that provides an output to a display peripheral, the reference voltage signal floats; however, if the graphics cable 12 carries an inbound signal to outbound port 24, the signal is driven to 5 Volts by the graphics card of the system generating the graphics signal. If cable connection detector 26 detects an input of a reference voltage, it determines that an inbound signal is incorrectly connected to an outbound port and it initiates display of an appropriate error message by graphics projector 14, such as the error message depicted on screen 20 of FIG. 1. For example, the error message is a visual depiction of the projector cable connections and an explanation of the detected connection to the outbound port plus instructions for reconnection to the inbound port. As another example, the error message is a video depiction of a disconnection of the graphics cable from the output port and a reconnection of the graphics cable to the input port. Logic for detection of an incorrect cable connection and presentation of an appropriate error message is stored in firmware of the projector and executed by a microprocessor controller that controls operation of the graphics projector.

Although the present invention has been described in detail, it should be understood that various changes, substitutions and alterations can be made hereto without departing from the spirit and scope of the invention as defined by the appended claims.

What is claimed is:

1. A system for error messaging of an incorrect graphics cable connection, the system comprising:

an information handling system having a graphics output port and operable to output a graphics signal at the port;

a peripheral having a graphics input port and operable to display a graphics signal communicated from an information handling system to the graphics input port, the peripheral further having a graphics output loop and graphics output port, the graphics output loop operable to communicate graphics signals received at the graphics input port for output at the graphics output port;

a graphics cable having first and second ends, the graphics cable operable to communicate the graphics signal from the information handling system; and a cable connection detector associated with the peripheral graphics output port, the cable connection detector operable to detect a graphics signal input to the graphics output port and to display an error message with the peripheral in response to detecting the graphics signal input.

2. The system of claim 1 wherein the peripheral comprises a graphics projector.

3. The system of claim 2 wherein the graphics input port, the graphics output port, and the cable ends have the same form factor.

4. The system of claim 3 wherein the graphics input port, graphics output port and the cable are VGA compliant.

5. The system of claim 4 wherein the graphics signal comprises a reference voltage signal, the cable connection detector operable to detect the reference signal to determine that a graphics signal for input to the peripheral from an information handling system is connected to the peripheral output port.

6. The system of claim 5 wherein the error message comprises a depiction of the peripheral graphics input and output ports.

7. The system of claim 6 wherein the depiction of the peripheral graphics input an output ports comprises a video depicting removal of a cable from the peripheral graphics output port and connection of the cable to the peripheral graphics input port.

8. A method for error messaging of an incorrect information handling system graphics cable connection, the method comprising:

connecting a graphics cable to a display peripheral graphics output port;

communicating a graphics signal from an information handling system output port through the graphics cable to the display peripheral graphics output port;

detecting at the display peripheral the input of the graphics cable signal to the output port; and displaying in response to the detecting an error message with the display peripheral that explains that the graphics cable signal is input to an incorrect port.

9. The method of claim 8 wherein the display peripheral comprises a graphics projector and displaying an error message comprises projecting an image with the graphics projector.

10. The method of claim 9 wherein the image comprises a depiction of the graphics projector having a correct and incorrect graphics cable connection.

11. The method of claim 9 wherein the image comprises a video depicting removal of the graphics cable from the output port and connection of the graphics cable to the input port.

12. The method of claim 8 wherein the graphics cable comprises input and output leads having the same form factor.

13. The method of claim 12 wherein the graphics cable, the information handling system output port, and the display peripheral output port are each VGA compliant.

14. The method of claim 13 wherein detecting further comprises detecting the reference voltage signal output from the graphics cable to the display peripheral output port reference pin.

15. The method of claim 8 further comprising:

disconnecting the graphics cable from the display peripheral output port in response to the error message; and connecting the graphics cable to the display peripheral input port in response to the error message.

16. A graphics projector comprising:

a housing;

processing components disposed in the housing and operable to accept a graphics signal for projecting an image;

an input port disposed at the housing and operable to accept the graphics signal from a cable lead having a first form factor;

an output port disposed at the housing and operable to send a graphics signal to a cable lead having a second form factor;

a graphics output loop operable to communicate graphics signals received at the input port to the output port; and a cable connection detector interfaced with the output port and operable to detect a graphics signal input to the graphics output port and to project an error message with the processing components in response to detecting the graphics signal input.

17. The graphics projector of claim 16 wherein the first and second form factors comprise VGA compliant form factors having a reference signal pin for communicating a reference signal with the graphics signal.

18. The graphics projector of claim 17 wherein the cable connection detector is further operable to detect a reference signal communicated into the output port.

19. The graphics projector of claim 16 wherein the error message comprises a depiction of the output and input ports with a correct cable connection for inputting a graphics signal.

20. The graphics projector of claim 16 wherein the error message comprises a video depicting a cable disconnected from the output port and reconnected to the input port.

* * * * *